US008869525B2

(12) United States Patent
Lingenauber et al.

(10) Patent No.: US 8,869,525 B2
(45) Date of Patent: Oct. 28, 2014

(54) EXHAUST-GAS TURBOCHARGER

(75) Inventors: Robert Lingenauber, Frankenthal (DE); Patrick Steingass, Alzey (DE); Jan Velthuis, Pitzeling (DE)

(73) Assignees: BorgWarner Inc., Auburn Hills, MI (US); Bayerische Motoren Werke Aktiengesellschaft, Munich (DE)

( * ) Notice: Subject to any disclaimer, the term of this patent is extended or adjusted under 35 U.S.C. 154(b) by 555 days.

(21) Appl. No.: 13/061,208

(22) PCT Filed: Sep. 10, 2009

(86) PCT No.: PCT/US2009/056428

§ 371 (c)(1),
(2), (4) Date: Feb. 28, 2011

(87) PCT Pub. No.: WO2010/033414

PCT Pub. Date: Mar. 25, 2010

(65) Prior Publication Data

US 2011/0171017 A1 Jul. 14, 2011

(30) Foreign Application Priority Data

Sep. 16, 2008 (DE) ..... 10 2008 047 448

(51) Int. Cl.

| | |
|---|---|
| ***F02D 23/00*** | (2006.01) |
| ***F02B 33/00*** | (2006.01) |
| ***F02B 67/10*** | (2006.01) |
| ***F01N 13/10*** | (2010.01) |
| ***F01D 25/28*** | (2006.01) |
| ***F01D 9/02*** | (2006.01) |
| ***F01D 25/26*** | (2006.01) |
| *F01N 3/00* | (2006.01) |
| *F01N 1/00* | (2006.01) |
| *F04B 17/05* | (2006.01) |
| *F02B 37/00* | (2006.01) |

(52) U.S. Cl.

CPC ..... *F01D 9/026* (2013.01); *F02B 67/10* (2013.01); *F01N 13/102* (2013.01); *F01D 25/28* (2013.01); *F05D 2230/232* (2013.01); *F05D 2220/40* (2013.01); *F02B 37/00* (2013.01); *F05D 2230/21* (2013.01); *F01N 2450/22* (2013.01); *F05D 2230/53* (2013.01); *F01D 25/26* (2013.01)

USPC ..... 60/602; 60/320; 60/322; 60/323; 60/324; 415/204; 415/205; 415/189; 415/196; 415/213.1; 415/214.1; 415/215.1; 417/406

(58) Field of Classification Search

USPC ..... 60/602, 612, 613, 320–324, 658; 415/204, 205, 189, 196, 213.1, 214.1, 415/215.1; 417/406

See application file for complete search history.

(56) References Cited

U.S. PATENT DOCUMENTS

| | | | |
|---|---|---|---|
| 3,930,747 | A | 1/1976 | Woollenweber |
| 3,948,052 | A | 4/1976 | Merkle et al. |

(Continued)

FOREIGN PATENT DOCUMENTS

| | | | |
|---|---|---|---|
| AT | 7372 | U1 | 2/2005 |
| DE | 2252705 | A1 | 5/1974 |

(Continued)

*Primary Examiner* — Thai Ba Trieu
*Assistant Examiner* — Jessica Kebea
(74) *Attorney, Agent, or Firm* — William G. Anderson; Stephan A. Pendorf; Patent Central LLC

(57) ABSTRACT

The present invention relates to an exhaust-gas turbocharger (1) having a turbine housing (2) and having a manifold section (3) which is connected to the turbine housing (2), wherein the turbine housing (2) and the manifold section (3) are formed as a single-piece cast part.

4 Claims, 2 Drawing Sheets

(56) References Cited

U.S. PATENT DOCUMENTS

| | | | | |
|---|---|---|---|---|
| 4,187,678 | A * | 2/1980 | Herenius | 60/321 |
| 4,294,073 | A | 10/1981 | Neff | |
| 5,463,867 | A | 11/1995 | Ruetz | |
| 5,761,905 | A * | 6/1998 | Yamada et al. | 60/322 |
| 6,062,024 | A | 5/2000 | Zander et al. | |
| 6,122,911 | A * | 9/2000 | Maeda et al. | 60/323 |
| 6,247,552 | B1 * | 6/2001 | Kovar et al. | 181/240 |
| 6,256,990 | B1 | 7/2001 | Itoh | |
| 6,343,417 | B1 * | 2/2002 | Bonny et al. | 29/890.08 |
| 6,892,532 | B2 * | 5/2005 | Bruce et al. | 60/323 |
| 7,089,737 | B2 | 8/2006 | Claus | |
| 7,234,302 | B2 | 6/2007 | Koerner | |
| 7,434,390 | B2 * | 10/2008 | Nording et al. | 60/323 |
| 7,610,758 | B2 | 11/2009 | Augstein et al. | |
| 7,731,241 | B2 * | 6/2010 | Aoki et al. | 285/129.1 |
| 7,836,692 | B2 * | 11/2010 | Leroy | 60/602 |
| 8,375,707 | B2 * | 2/2013 | Muller | 60/323 |
| 8,549,851 | B2 * | 10/2013 | Grussmann et al. | 60/323 |
| 2002/0174650 | A1 * | 11/2002 | Durr et al. | 60/323 |
| 2004/0083730 | A1 * | 5/2004 | Wizgall et al. | 60/614 |
| 2005/0072143 | A1 * | 4/2005 | Diez | 60/321 |
| 2005/0126163 | A1 | 6/2005 | Bjornsson, Sr. | |
| 2005/0144946 | A1 * | 7/2005 | Claus | 60/605.1 |
| 2005/0183414 | A1 * | 8/2005 | Bien et al. | 60/323 |
| 2006/0131817 | A1 | 6/2006 | Kerelchuk | |
| 2007/0289954 | A1 * | 12/2007 | Bien et al. | 219/121.46 |
| 2008/0289323 | A1 * | 11/2008 | Diez et al. | 60/323 |
| 2009/0031722 | A1 * | 2/2009 | An et al. | 60/600 |
| 2009/0188247 | A1 * | 7/2009 | Phillips et al. | 60/323 |
| 2010/0038901 | A1 * | 2/2010 | Schmidt et al. | 285/294.1 |
| 2010/0047054 | A1 | 2/2010 | Doerle et al. | |
| 2010/0126156 | A1 * | 5/2010 | Diez et al. | 60/323 |
| 2010/0223911 | A1 * | 9/2010 | Gockel et al. | 60/280 |
| 2013/0014497 | A1 * | 1/2013 | Wu et al. | 60/323 |

FOREIGN PATENT DOCUMENTS

| | | | | |
|---|---|---|---|---|
| DE | 3925802 | A1 * | 2/1991 | F01N 7/10 |
| DE | 4342572 | C1 | 11/1994 | |
| DE | 102004054726 | A1 | 6/2006 | |
| DE | 69927233 | T2 | 7/2006 | |
| DE | 60312535 | T2 | 11/2007 | |
| DE | 102009030014 | A1 * | 12/2010 | F01N 13/10 |
| EP | 1536141 | B1 | 6/2005 | |
| GB | 2060066 | A | 4/1981 | |
| JP | 63215809 | A * | 9/1988 | F01N 7/10 |
| JP | 2000161056 | A | 6/2000 | |
| JP | 2003221639 | A | 8/2003 | |
| WO | 2008055588 | A1 | 5/2008 | |

* cited by examiner

EXHAUST-GAS TURBOCHARGER

FIELD OF THE INVENTION

The invention relates to an exhaust-gas turbocharger.

BACKGROUND OF THE INVENTION

Exhaust-gas-turbocharged internal combustion engines are nowadays often fitted with air-gap-insulated exhaust manifolds which are expediently produced in a two-shell design from thin-walled sheet-metal parts. The turbine housing is generally composed of cast materials with correspondingly greater wall thicknesses.

With air-gap-insulated manifold technology, the heat loss from the hot exhaust gas and likewise the surface temperature are reduced in relation to conventional cast manifolds on account of the lower masses. A greater amount of thermal energy is therefore made available to the downstream turbine of the exhaust-gas turbocharger for power conversion.

Air-gap-insulated manifolds are used in combination with both single-channel and also twin-channel turbine housings. Twin-channel turbine housings are used with so-called pulse supercharging, in which, for example in the case of a 4-cylinder or 6-cylinder engine, the exhaust-gas flows of in each case 2 or 3 cylinders are combined in groups and supplied in separate pipe lines to in each case one channel in the turbine housing. The individual channels in the turbine housing are separated from one another from the turbine housing inlet to the outlet from the spiral by a partition. In twin-channel turbine housings, the dynamic energy (pulsation) of the exhaust gases is additionally utilized for power conversion by means of the separation of individual exhaust gas flows.

With such complex components, however, the connecting technology between the thin-walled air-gap-insulated manifold and the comparatively thick-walled cast turbine housing has often proven to be relatively critical. On account of the available installation space, of the heat losses and leakage losses and on account of assembly requirements, the connection between the air-gap-insulated manifold and the cast turbine housing is often formed as a welded connection. With this type of connection in particular, problems arise on account of the materials, which are different for production reasons, of the air-gap-insulated manifold and of the cast turbine housing.

A further disadvantage, at least in the case of the twin-channel design of the turbine housing, is that the gas flows of the separate channels influence one another on account of leaks at the sliding connections within the air-gap-insulated manifold and in the region of the partition at the inlet into the turbine housing. The pulsation effect is therefore reduced as a result of the so-called "crosstalk" of the gas flows.

SUMMARY OF THE INVENTION

It is therefore an object of the present invention to create an exhaust-gas turbocharger which utilizes the advantages of an air-gap-insulated manifold and at the same time makes it possible to avoid the critical connecting technology between the air-gap-insulated manifold and the cast turbine housing.

This object is achieved by means of an exhaust-gas turbocharger in which the turbine housing and the manifold section, which is composed of the exhaust ducts of at least two cylinders, are formed as a single-piece cast part which can be referred to as a turbine-housing/manifold module.

The object is likewise achieved by means of an exhaust-gas turbocharger in which the turbine housing is formed as a cast part and the manifold section is formed as a separate cast part, which cast parts can be connected to one another after being produced by casting.

This embodiment is aimed at applications in which particular mounting conditions of the exhaust-gas turbocharger on the engine and the spatial conditions in the engine bay of the vehicle may result in such a complicated geometry of the manifold section that casting the manifold section together with the turbine housing would be made impossible. In this case, the manifold section and the turbine housing may be cast as separate individual parts that are subsequently connected to one another. The connection of the two individual parts to one another may take place by means of welding, a flange connection, a V-strap connection or similar suitable connecting methods.

The turbine housing may be of either single-channel or twin-channel design.

For a twin-channel turbine housing, the manifold section is designed such that, for the separation of the channels, each turbine housing duct extends separately up to the cylinder head and is acted on with exhaust gas from in each case one cylinder or from a plurality of cylinders combined in groups, and the dynamic energy (pulsation) of the exhaust gas is therefore additionally used for power conversion. To receive the exhaust-gas flows from the other cylinders, for example cylinders 1 and 4 in a 4-cylinder engine or cylinders 1, 2 and 5, 6 in a 6-cylinder engine, the manifold section is provided with openings at the sides, to which openings the exhaust lines of the cylinders are then connected by means of a plug-type connection or the like. The plug-type connections of the exhaust lines of further cylinders to one another and to the manifold section should be designed such that length variations as a result of thermal expansions can be compensated.

The turbine housing with the integrally cast manifold section is fastened to flanges, provided specifically for the purpose, on the cylinder head, for example at cylinders 2 and 3, and therefore serves as the main supporting element for the entire exhaust-gas turbocharger (turbine-housing/manifold module). The additional exhaust lines of the other cylinders are themselves fastened to corresponding flanges on the cylinder head.

Correspondingly shaped sheet-metal shells are arranged around the individual exhaust lines including the integrally cast manifold section, which sheet-metal shells form the so-called outer shell. The insulating air intermediate space is thereby formed between the hot lines which conduct exhaust gas and the outer shell. The outer shell is composed of at least two sheet-metal molded parts which are welded in a gas-tight fashion to one another and to the manifold section in the region of the transition to the turbine housing. It is also conceivable to use other connecting techniques, such as folding, brazing, riveting, screw connections etc. or combinations of the different types of connection, for the outer shell instead of welding. The at least two sheet-metal shells are not arranged around the turbine housing.

As a result of this design, specifically providing the channel separation directly at the cylinder head outlet in the case of a twin-channel turbine housing, it is ensured that the so-called "crosstalk" of the individual channels cannot take place and the pulsation effect of the exhaust gas is therefore utilized more effectively for power conversion. A further advantage is that the design-induced and functionally induced leakage flows at the plug-type connections of the exhaust pipe of the individual groups of cylinders likewise cannot influence one another.

In contrast to pulse supercharging in which a 2-channel turbine housing is imperatively necessary, no separation of the exhaust-gas flows takes place with so-called ram supercharging. Here, the exhaust-gas flows of all the cylinders are merged in a so-called collector and are supplied to the turbine wheel through the single-channel turbine housing. The teaching of the invention is expedient here too, specifically a turbine housing having an integrally cast manifold section which is designed in this case as a collector. The supply of the individual exhaust-gas flows to the collector and the fastenings of the turbine housing with "collector manifold" and of the individual exhaust lines take place in the same way as for a 2-channel design.

BRIEF DESCRIPTION OF THE DRAWINGS

Further details, features and advantages of the invention can be gathered from the following description of an exemplary embodiment on the basis of the drawings, in which.

DETAILED DESCRIPTION OF THE INVENTION

Figure 1:
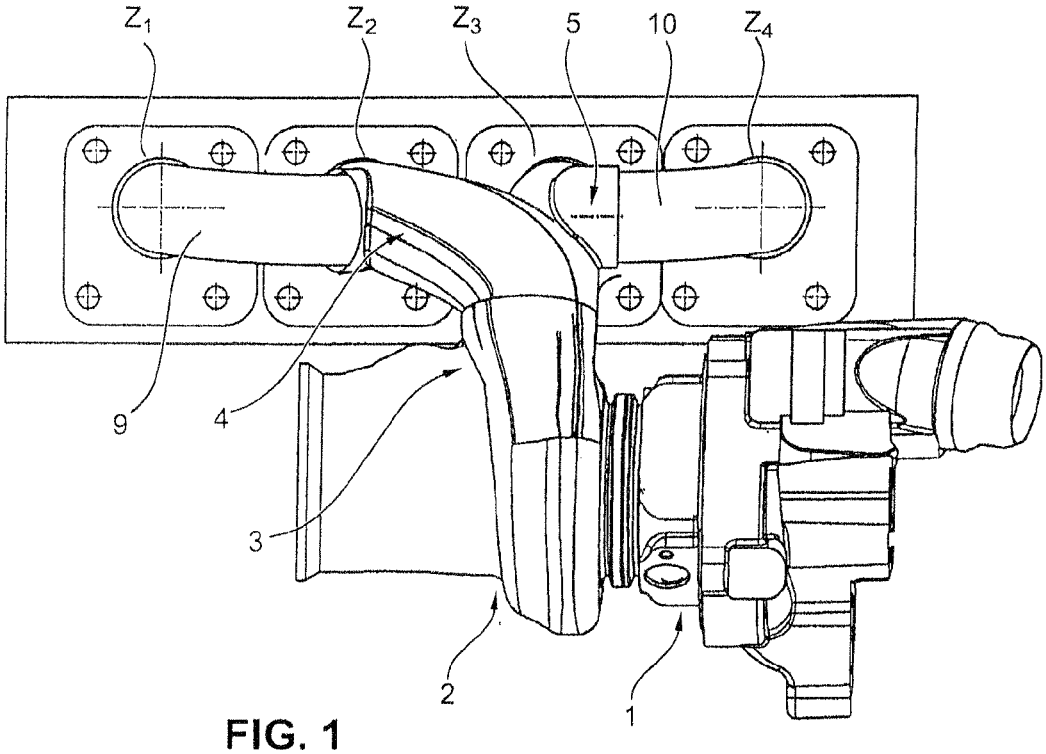
FIG. 1 shows an illustration of an exhaust-gas turbocharger according to the invention.

FIG. 1 illustrates an exhaust-gas turbocharger 1 which is provided with a turbine housing 2 and a manifold section 3. The exhaust-gas turbocharger 1 self-evidently has all the other components of conventional turbochargers, but these are not described below since they are not necessary for explaining the principles according to the invention.

In the embodiment illustrated in FIG. 1, the turbine housing 2 and the manifold section 3 are formed as a single-piece cast part.

Figure 2:
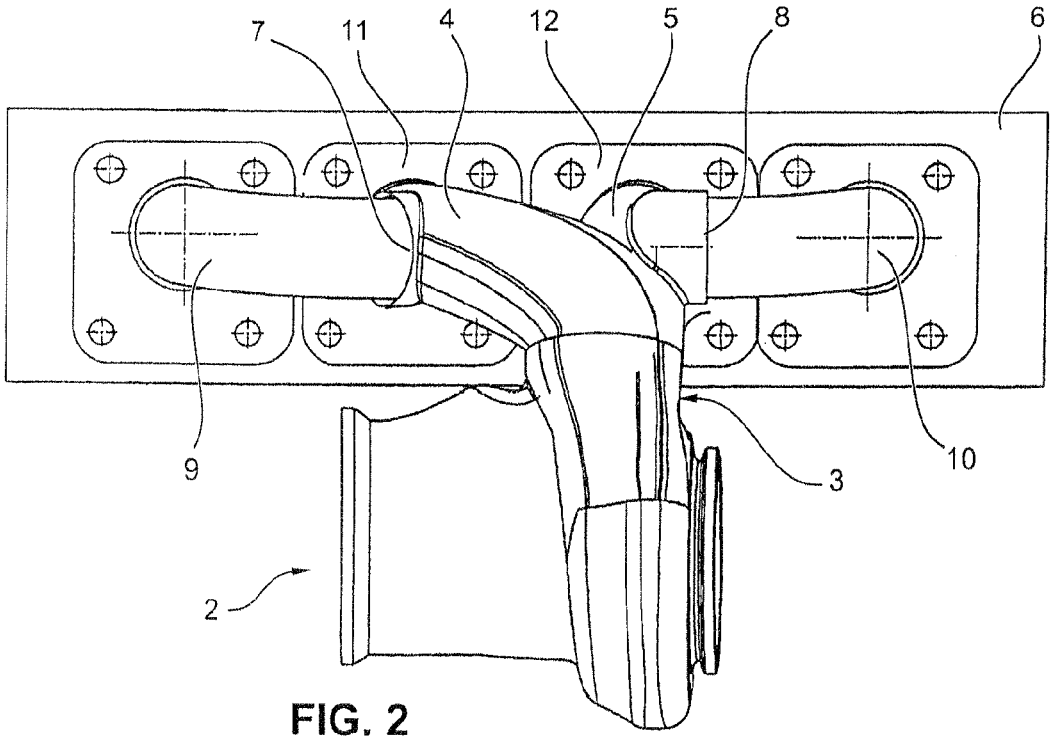
FIG. 2 shows an illustration of the turbine housing of the exhaust-gas turbocharger according to the invention.
Figure 3:
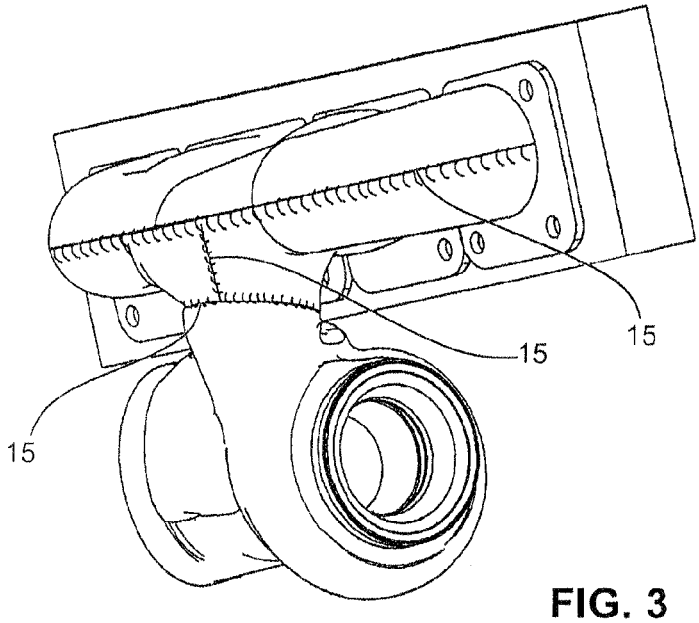
FIG. 3 shows an illustration of the weld seams on the outer shells of the manifold module.
Figure 4:
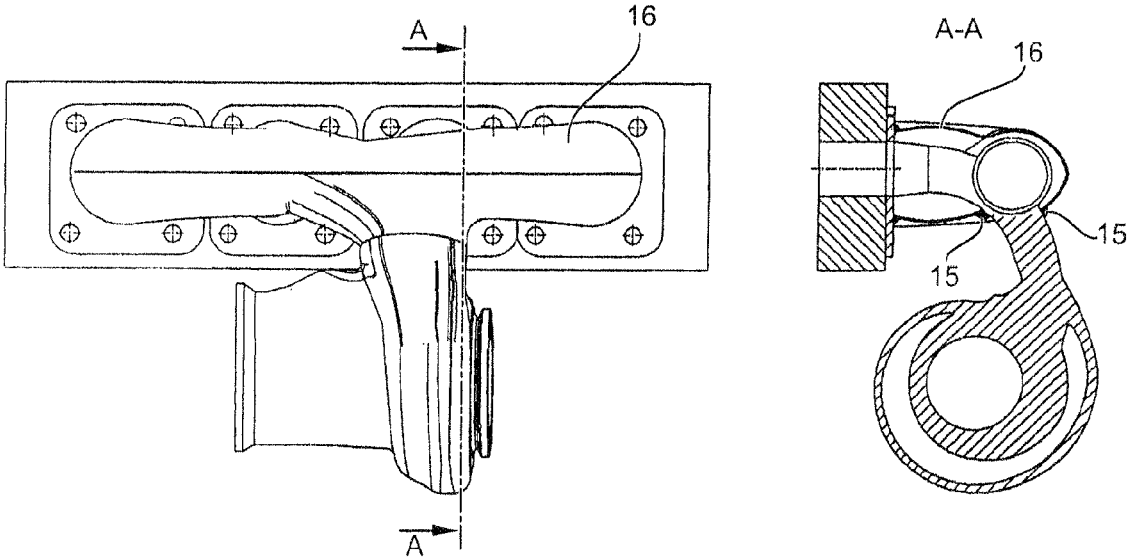
FIG. 4 shows a section through the manifold section and turbine housing.

The design can also be seen from the enlarged illustration of FIG. 2, wherein it should be emphasized that the embodiment is provided for a twin-channel turbocharger which has separate turbine housing ducts which, in the illustrated embodiment, extend in the form of manifold ducts 4, 5 up to the cylinder head 6. Flanges 11 and 12 are provided for fastening the entire unit to the cylinder head 6.

In the embodiment illustrated in FIGS. 1 and 2, the manifold section 3 also has side openings 7 and 8 which serve for connecting further exhaust lines 9 and 10 which make it possible for the exhaust gases from further cylinders Z1 to Z4 to be supplied to the manifold 3.

In addition to the above written disclosure of the invention, reference is hereby made to the graphic illustration of the invention in FIGS. 1 to 4.

LIST OF REFERENCE SYMBOLS

1 Exhaust-gas turbocharger
2 Turbine housing
3 Manifold section
4, 5 Manifold ducts
6 Cylinder head
7, 8 Lateral openings
9, 10 Exhaust lines
11, 12 Connecting flanges
15 Connecting points of the outer sheet-metal shells
16 Outer sheet-metal shells
Z1, Z2, Z3, Z4 Cylinders 1, 2, 3 and 4

The invention claimed is:

1. An exhaust-gas turbocharger (1) comprising:
a turbine housing (2);
a manifold section (3) connected to the turbine housing (2), wherein the turbine housing (2) and the manifold section (3) are formed as a single-piece cast part, wherein the manifold section (3) is provided with openings (7, 8) at the sides for connecting further exhaust lines (9, 10); and
at least two sheet-metal shells (16) arranged around the manifold section (3) and the exhaust lines (9, 10) so as to form an air gap between the at least two sheet-metal shells and the manifold section and the exhaust lines, wherein the at least two sheet-metal shells are not arranged around the turbine housing, and wherein the at least two sheet-metal shells are connected to one another in a gas-tight fashion at connecting points (15).

2. The exhaust-gas turbocharger as claimed in claim 1, wherein the turbine housing (2) is designed as a twin-channel turbine housing with two turbine housing ducts (4, 5) which extend in each case separately up to a cylinder head (6) via the manifold section (3).

3. The exhaust-gas turbocharger as claimed in claim 1, wherein the manifold section (3) is provided with connecting flanges (11, 12).

4. The exhaust-gas turbocharger as claimed in claim 1, wherein the manifold section (3) is designed as a collector into which all of the exhaust lines from the respective engine cylinders open out.

* * * * *